US006340154B1

(12) United States Patent
Young

(10) Patent No.: US 6,340,154 B1
(45) Date of Patent: Jan. 22, 2002

(54) MOTORIZED CLAMP DEVICE

(76) Inventor: Craig D. Young, 2027 N. Lake Ave., #9, Altadena, CA (US) 91001

( * ) Notice: Subject to any disclaimer, the term of this patent is extended or adjusted under 35 U.S.C. 154(b) by 0 days.

(21) Appl. No.: 09/624,830

(22) Filed: Jul. 25, 2000

(51) Int. Cl.[7] ..... B25B 1/10

(52) U.S. Cl. ..... 269/246; 254/215; 254/249; 254/216; 254/3

(58) Field of Search ..... 254/215, 246, 254/216, 249, 143, 3, 6

(56) References Cited

U.S. PATENT DOCUMENTS 4,436,294 A * 3/1984 Irelan ..... 269/6
4,736,927 A * 4/1988 Clancy ..... 269/246
4,770,401 A * 9/1988 Donaldson ..... 269/249
5,110,100 A * 5/1992 Cotton ..... 269/244
5,139,246 A * 8/1992 Yakon ..... 269/242

* cited by examiner

*Primary Examiner*—Joseph J. Hail, III
*Assistant Examiner*—Lee Wilson
(74) *Attorney, Agent, or Firm*—John K. Park; Park & Sutton LLP

(57) ABSTRACT

The motorized clamp device includes a motor housing having a first channel. A first motor is movably positioned within the first channel. The first motor moves back and fourth within the first channel thereby increasing or decreasing the distance 'd1' between a first and second contact surface. The motor control switch actuates the first motor and is attached to the motor housing. The second contact is attached to the motor housing. The motorized capability of the motorized clamp device minimizes the manual adjustments that must be performed by the operator.

20 Claims, 6 Drawing Sheets

MOTORIZED CLAMP DEVICE

BACKGROUND

The field of invention relates to clamping devices and spreader devices. Clamps of various designs and shapes are used for a variety of purposes. Typically they require manual adjustment to increase or decrease the width between the clamp ends.

Manual adjustment can be time consuming, tedious and fatiguing when the worker is required to open and close the clamp numerous times. Manual adjustment clamps can be especially burdensome when the worker must operate the clamp repeatedly during a short period of time.

Traditional clamp designs require that both hands of the operator be used to tighten and loosen the clamp. Often the operator has a need to use one hand for holding the object to be clamped. The requirement for holding the objects arises when a specific alignment is desired between the object and the clamp or when an object needs to be held stable as the clamp is applied. Specific alignment of the objects prior to clamping is particularly challenging when there are several objects to be aligned and clamped simultaneously. This can be very unwieldy, frustrating and time consuming for one operator to attempt to hold the objects and operate the clamp simultaneously.

The common alternative is for two operators to cooperate in the procedure, with one holding the object and the other operator applying the clamp. Once again, unnecessary expenses are incurred when two workers perform a clamping task that could be accomplished by one worker, if the appropriate clamping device were available.

Another draw back of traditional clamp designs is the slow operation of the clamp when being manually adjusted by the operator. This is a time consuming task to slowly increase or decrease the spacing between the clamp ends. The working hours lost in adjusting the clamp spacing can be particularly expensive when the objects being clamped vary significantly in size and the objects are changed with great frequency.

Clamping devices are used in many trades, including applications by framers, mechanics and carpenters. Picture framers have a requirement for applying two clamps at a 90 angle to the corner of a picture frame. The side pieces of the picture frame are glued together and the clamp is used to hold them securely while the glue hardens. The side pieces of the picture frame are angled so they press against one another when pressure is applied to each of them in the proper direction. The two clamps must both be tightened with approximately the same pressure at the same time or the alignment of the picture frame sides will be distorted. This operation requires alternating the tightening and turning procedure between the two clamps, while still holding one side of the picture frame in a fixed and aligned position against the adjacent side of the picture frame. This operation must be done subsequently for each of the four corners of the picture frame. There is a need for a clamping device that will simultaneously tighten two clamps with a minimum of physical effort, thus allowing the framer to focus his attention on the proper alignment of the picture frame.

Picture framers, mechanics and carpenters often spend many hours twisting and turning the clamping device during their daily routine. Some workers have developed carpal tunnel syndrome of their hands and wrists due to this repeated operation. A clamping device that reduces the physical effort would be of great medical benefit to these individuals.

The inadequacies of traditional clamp designs indicate there is a need for a clamping device that can be held with one hand, while being accurately adjusted with minimal physical effort. There is also a need for the clamp that provides quick adjustment for increasing or decreasing the spacing between the clamp ends. The clamping device should have the option of a foot operated switch that allows the hands to remain free.

SUMMARY

It is an object of the present invention, a motorized clamping device, to overcome the disadvantages of the traditional clamp designs.

An advantage of the motorized clamping device is its capability to quickly move the motorized adjustable clamp for increasing or decreasing the spacing between the clamp ends, through the use of a motor controlled by an activation switch or motor switch located on the device. The motor may include a variable speed mode or adjustable torque. The manual clamp may be fixed or a manual adjustment bar provides even greater flexibility in quickly adjusting the spacing between the clamps.

Another objective of the present invention is providing a tool that will function both as a clamp that applies pressure upon an object to adhere surfaces together and also function as a spreader, which applies force to spread apart and separate portions of an object. The motorized clamping device accomplishes this objective by having the motor housing removable and reversible, so that the contact surfaces now move away from each other thus acting as a spreader function.

The manual adjustment bar is provided with numerous selection points for adjusting the spacing. Multiple teeth creating a saw-tooth design is one method. The adjustment device can be located near the handhold, so there is minimal movement or wasted time is adjusting the manual adjustment bar.

By combining two clamp heads and two motors, the present invention satisfies the objective of a clamping device that will simultaneously tighten two clamps with a minimum of physical effort, thus allowing the picture framer to focus his attention on the proper alignment of the picture frame.

Another object of the invention is to have the motorized clamping device used as a vise attached to a workbench. This is accomplished through the use of a worm gear or a helical gear that allows the motor housing to be placed under or to the rear of the workbench, while the clamping jaws are on the top surface of the workbench. This arrangement avoids having the motor hanging on the end of the adjustable clamp as occurs in other applications.

Another advantage of the motorized clamping device is labor and time savings by allowing the operator to use only one hand to adjust the spacing between clamp ends. This is accomplished by placing the adjustment switch near the handle of the device. There is also a need for a motorized clamping device that provides quick adjustment for increasing or decreasing the spacing between the clamp ends without the use of either hand. The motorized clamping device may have the option of a foot-operated switch that allows the hands to remain free.

The motorized clamp device includes a motor housing having a first channel with a first motor movably positioned within the first channel. A motor control switch is attached to the motor housing. A first head is attached to and powered by the first motor. The first head has a first shaft and a first contact surface.

A first torque collar is attached to the motor housing. The first torque collar has a first aperture that receives the first shaft. There is a second contact surface attached to the motor housing. When the first motor causes the first shaft to rotate, the first shaft passes through the first aperture of the first torque collar and force is applied to an object by the first contact surface and the second contact surface. The first motor travels within the first channel as the first shaft passes through the first torque collar.

Attached to the first motor is a first motor collar that has a first ear, which is received by the first channel. When the first shaft rotates, the first ear is held within the first channel thus preventing the first motor from rotating within the motor housing. This causes the first shaft to move through the first torque collar and the first motor to move with the first shaft, the first motor moving back and forth within the first channel of the motor housing.

The motorized clamp device has a manual clamping bar that has an inner surface and a saw tooth edge. The saw tooth edge has a plurality of teeth.

The second contact surface is attached to the inner surface of the manual clamping bar and the motor housing receives the manual clamping bar. The object may be firmly secured between the second contact surface on the manual clamping bar and the first contact surface of the first head, when the first head is actuated and applies pressure to a portion of the article.

In a variation of the invention the first motor is a first bi-directional motor and a power source is attached to the motor housing for energizing the first bi-directional motor. The first bi-directional motor includes the capability to halt the forward movement of the shaft when a preset pressure is achieved upon the object.

An adjustment device can be added that controls the range of adjustment of the manual clamping bar, such that, the manual clamping bar is incrementally adjusted between the plurality of teeth by the adjustment device.

The manual clamping bar has a travel stop, such that when the travel stop comes into contact with the motor housing the travel stop limits the maximum distance of travel for the manual clamping bar.

The invention can be configured as a spreader where a second contact surface is attached to the outer surface of the manual clamping bar and the motor housing receives the manual clamping bar. When the first shaft passes through the first torque collar and exits the motor housing the first contact surface and the second contact surface increase the distance 'd2' between them. This increasing of the distance 'd2' creates a spreading effect.

Another version allows the invention to function for both spreading and clamping functions in the work place. The second contact surface is attached to the inner surface of the manual clamping bar. A third contact surface is attached to the outer surface of the manual clamping bar. The motor housing is removably attached to the manual clamping bar such that the motor housing may be removed from the manual clamping bar, be reversed and reattached to the motor housing. This allows the first contact surface to face about 180 degrees from the initial orientation of the first contact surface such that the first contact surface faces away from the third contact surface.

When the first shaft passes through the first torque collar and exits the motor housing the first contact surface and the third contact surface increase the distance 'd2' between them, creating a spreading effect. When the motor housing is in its initial position the object may be firmly secured between the second contact surface on the manual clamping bar and the first contact surface of the first head, when the first head is actuated and applies pressure to a portion of the article.

For picture frame assembly and other applications the motor housing has a second channel with a second motor movably positioned within the second channel. A second head is attached to and powered by the second The second head has a second shaft and the second contact surface is attached to the second shaft. A second torque collar is attached to the motor housing, the second torque collar having a second aperture that receives the second shaft.

A second motor collar is attached to the second motor, similar to the construction of the first motor collar with an ear and the first motor. The motor collar has a second ear and the second channel receiving the second ear.

The first shaft has a first axis running along the first centerline of the first shaft and a second axis running along the second centerline of the second shaft. The intersection of the first axis and second axis create an angle $\alpha$ that is less than a 180 degree angle, such that an opposing object receives force from the first head and the second head. When the motor housing is substantially an "L" shape and the angle $\alpha$ is about a 90 degree angle, the first head applies pressure in a generally horizontal direction and the second head applies pressure in direction that varies 90 degrees from the direction of the first head.

The first motor is a first bi-directional motor and the second motor is a second bi-directional motor. The forward movement is stopped of the first bi-directional motor and the second bi-directional motor, the first shaft, second shaft, first contact surface, and second contact surface when a preset pressure is achieved upon the opposing object. The motor control switch in one variation is a foot-operated switch that allows the hands to remain free.

The invention is described in greater detail and specificity in the appended drawings, claims and description.

DETAILED DESCRIPTION OF THE DRAWINGS

Figure 1:
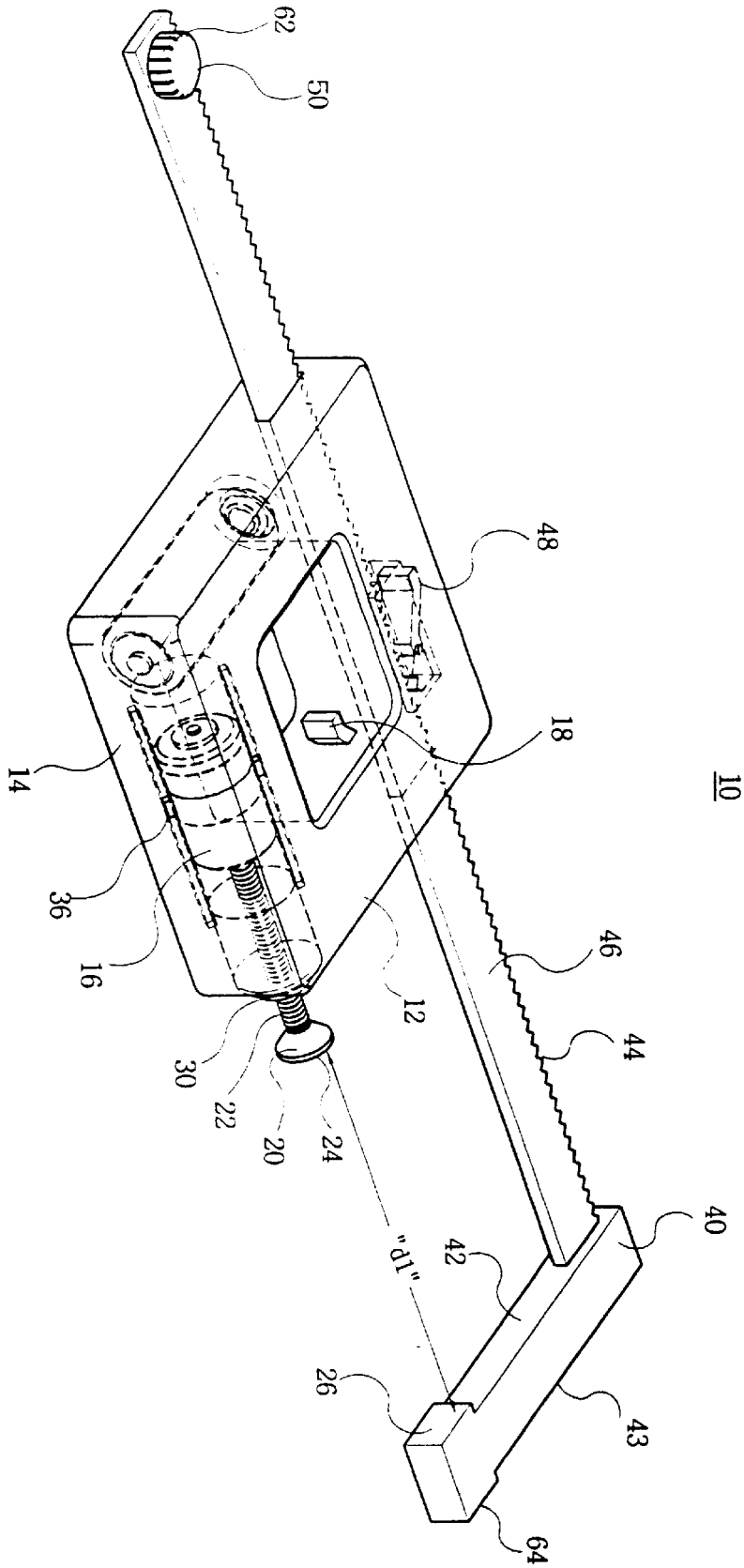
FIG. 1 is a perspective view of the motorized clamp device with a single motor.
Figure 2:
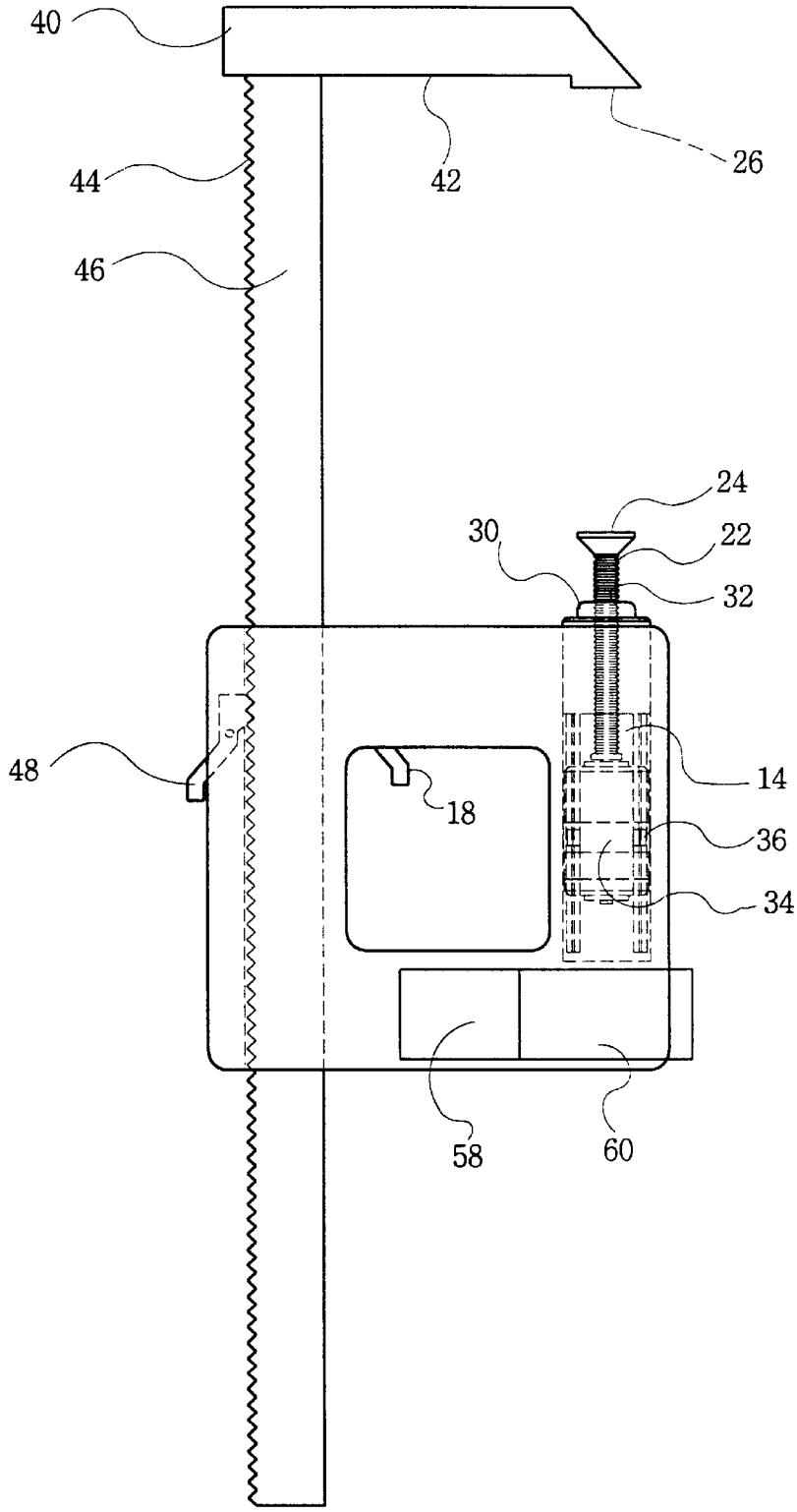
FIG. 2 is a side view of the motorized clamp device.

Referring to FIGS. 1–6*a*, specifically to FIG. 1 and FIG. 2, the motorized clamp device 10 includes a motor housing 12 having a first channel 14. A first motor 16 is movably positioned within the first channel 14. The motor control switch 18 and a reversing motor control switch 19 actuate the first motor 16 and are attached to the motor housing 12. Attached to and powered by the first motor 16 is the first head 20. The first head 20 has a first shaft 22 and a first contact surface 24. There is a second contact surface 26 attached to the motor housing 12.

The first motor 16 moves back and forth within the first channel 14 thereby increasing or decreasing the distance 'd2' between first contact surface 24 and a second contact surface 26. This action clamps an object between the first contact surface 24 and a second contact surface 26. The motorized capability of the motorized clamp device 10 minimizes the manual adjustments that must be performed by the operator.

The first torque collar 30 is attached to the motor housing 12. The first torque collar 30 has a first aperture 32 that receives the first shaft 22. When the first motor 16 causes the first shaft 22 to rotate, the first shaft 22 passes through the first aperture 32 of the first torque collar 30 and force is applied to an object by the first contact surface 24 and the second contact 26 surface. The first motor 16 travels within the first channel 14 as the first shaft 22 passes through the first torque collar 30.

Figure 4:
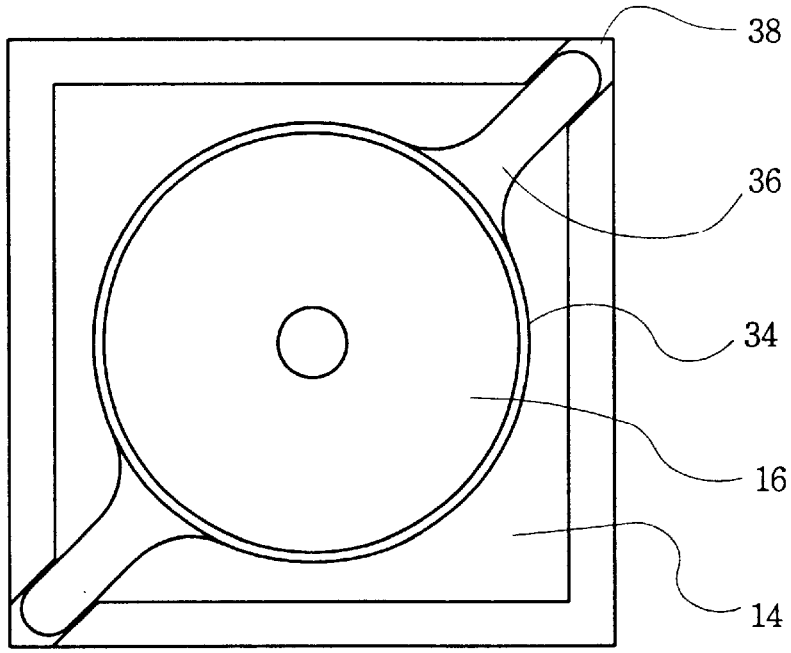
FIG. 4 shows a view of the channel, motor and motor collar with ears.

FIG. 4 shows a first motor collar 34 with a first ear 36 that prevents the first motor 16 from twisting within the first channel 14 when the first motor 16 rotates. The first motor collar 16 is secured around the perimeter and attached to the first motor 16. The first ear 36 is shaped to fit within a groove 38 in the first channel 14, so that the first channel 14 receives the first ear 36.

When the first shaft 22 rotates, the first ear 36 is held within the first channel 14 thus preventing the first motor 16 from rotating within the motor housing 12. Since the first motor 16 will not rotate this causes the first shaft 22 to move through the first torque collar 30 and the first motor 16 to move along with the first shaft 22. The first motor 16 moves back and forth within the first channel 14 of the motor housing 12.

When a larger object needs to be clamped a preferred embodiment includes a manual clamping bar 40 that can be adjusted. The manual clamping bar 40 has an inner surface 42, an outer surface 43, saw tooth edge 44, with the saw tooth edge 44 having a plurality of teeth 46. The second contact surface 26 is attached to the inner surface 42 of the manual clamping bar 40 and the motor housing 12 receives the manual clamping bar 40. The manual clamping bar 40 can be incrementally adjusted along the plurality of teeth 46 by an adjustment device 48 that controls the range of adjustment of the manual clamping bar 40. A travel stop 50 can prevent the manual clamping bar 40 from slipping out of the motor housing 12.

After the operator adjusts the manual clamping bar 40 to the proper size and the object is placed between the first contact surface 24 and the second contact surface 26, then the first motor 16 can be actuated to further tighten the motorized clamp device 10. The object is then firmly secured between the second contact surface 26 on the manual clamping bar 40 and the first contact surface 24 of the first head 20, when the first head 20 is actuated and applies pressure to a portion of the object.

The first motor 16 can be a first bi-directional motor 52. When a second motor 70 is added the second motor 70 can be a second bi-directional motor 56. Although not shown the first head 20 can include a ball joint so that the first head 20 can be adjusted to differing angles.

The motorized clamp device 10 has a power source 58 attached to the motor housing 12 for energizing the first bi-directional motor 52 or the second bi-directional motor 56. The power source is typically a battery 60 that can be recharged or replaced. In a variation the power source 58 could be external and separate from the motorized clamp device 10. Although not shown, an option to power the motorized clamp device 10 from a car cigarette lighter will provide ease and convenience for the operator when he is on remote construction sites without convenient access to electrical outlets.

The manual clamping bar 40 has a travel stop 50 that prevents the manual clamping bar 40 from inadvertently coming completely out of the motor housing 12. When the travel stop 50 comes into contact with the motor housing 12 the travel stop limits the maximum distance of travel for the manual clamping bar 40. The travel stop 50 can be a knurled knob 62 that is easy to grasp and can be threaded for easy removal from the manual clamping bar 40.

One version of the manual clamping bar 40 has a range of adjustment of about 9 inches travel and the first head 20 has a range of adjustment of about 1 inch travel.

Figure 3:
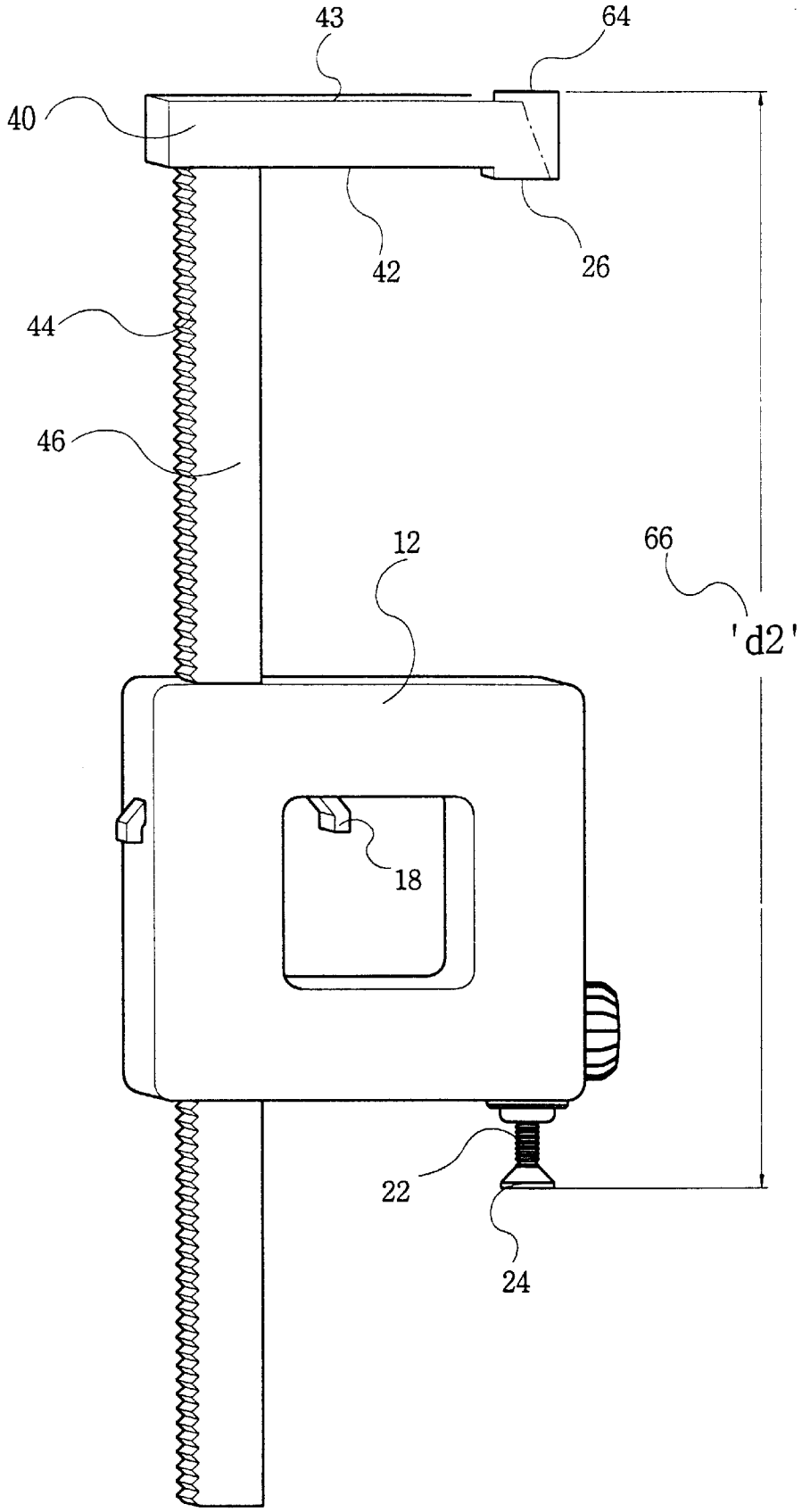
FIG. 3 shows a side view of the motorized clamp device in the configuration of a spreader device.

Referring particularly to FIG. 3, the manual clamping bar 40 has an outer surface 43 that can include a third contact surface 64 attached to the outer surface 43. With the travel stop 50 removed the manual clamping bar 40 and motor housing 12 can be separated allowing the motor housing 12 to be reversed and then reattached to the manual clamping bar 40. When the motor housing 12 is reversed the first shaft 22 and first contact surface 24 now face in the opposite direction. The first contact surface 24 faces about 180 degrees from the initial orientation of the first contact surface 24 such that the first contact surface 24 faces away from the third contact surface 64. When the first shaft 22 passes through the first torque collar 30 and exits the motor housing 12 the first contact surface 24 and the third contact surface 64 increase the distance 'd2' 66 between them, thereby creating a spreading effect.

The second contact surface 26 is attached to the inner surface 42 of the manual clamping bar 40. When the motor housing 12 is in its initial position the object may be firmly secured between the second contact surface 26 on the manual clamping bar 40 and the first contact surface 24 of the first head 20. The combination of a second contact surface 26 and a third contact surface 64 allows the manual clamp device 10 to be use both for clamping of objects and spreading of objects.

The motorized clamp device 10 can include the feature where the first bi-directional motor 52 or the second bi-directional motor 56 halts their forward movement of the first shaft 22 or second shaft 72 when a preset pressure is achieved upon the object.

Figure 5:
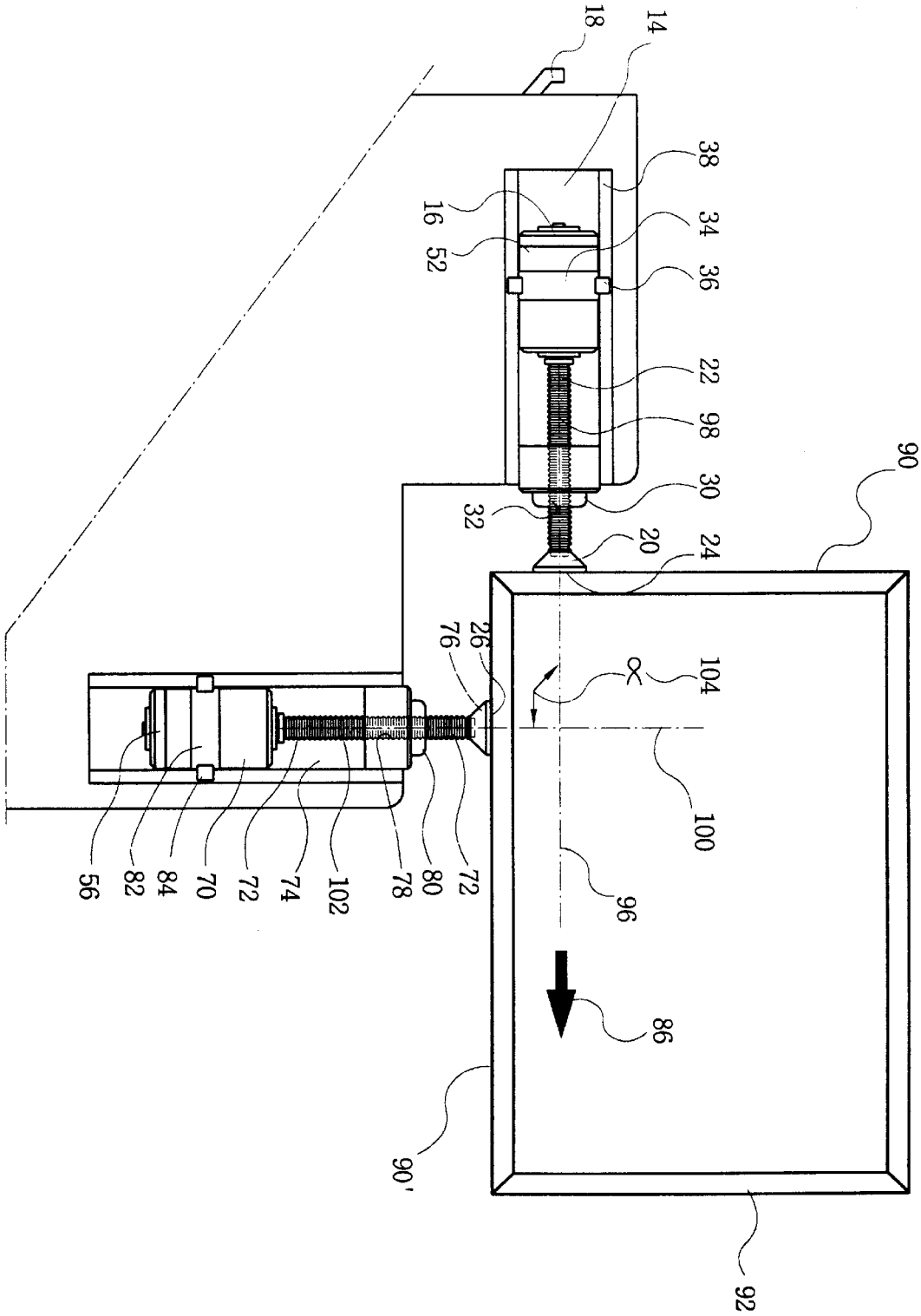
FIG. 5 is a top view of the motorized clamp device with two motors arranged at a 90 degree angle that is useful for picture frame assembly.

Referring to FIG. 5, a second motor 70 may be added to the device 10 this requires there also be a second channel 74. The second motor 70 is similar in structure to the first motor 16. The second motor 70 is movably positioned within the second channel 74. The second head 76 is attached to and powered by the second motor 70. The second head 76 has a second shaft 72 and the second contact surface 26 is attached to the second shaft 72. A second torque collar 78 is attached to the motor housing 12 with the second torque collar 78 having a second aperture 80 that receives the second shaft 72.

A second motor collar 82 is attached to the second motor 70. The second motor collar 82 has a second ear 84 that is received by the second channel 74. When the second shaft 72 rotates the second ear 84 is held within the second channel 74 thus preventing the second motor 70 from rotating within the motor housing 12. Since the second motor 70 is prevented from rotating this causes the second shaft 72 to move through the second torque collar 78 and the second motor 70 to move with the second shaft 72. The second motor 70 moving back and forth within the second channel 74 of the motor housing 12.

The first motor 16 and second motor 70 can be positioned within the motor housing 12 so that the first head 20 applies pressure in a generally horizontal direction 86 and a second head 76 applies pressure at a 90 degree angle to the first head 20.

This arrangement of a first motor 16 and second motor 70 is ideal for use in picture framing applications where the sides 90, 90' of the picture frame 92 must be assembled together by gluing. The first head 20 applies pressure to one side 90 of the picture frame and the second head 76 applies pressure to the other side 90,of the picture frame while the glue dries and adheres the sides 90, 90' of the picture frame 92 together. Although not illustrated, when two motorized clamp device 10 are used then all four sides 90, 90' of the picture frame 92 can be assembled and glued simultaneously.

FIG. 5 illustrates the first shaft 22 with a first axis 96 running along the first centerline 98 of the first shaft 22 and a second axis 100 running along the second centerline 102 of the second shaft 72. The intersection of the first axis 96 and second axis 100 create an angle $\alpha$ 104 that is less than a 180 degree angle, such that an opposing object receives force from the first head 20 and the second head 76.

The first motor 16 and second motor 70 can be positioned in substantially an "L" shape. One alternate arrangement for picture framing applications is with the motor housing 12 in substantially an "L" shape with both the first motor 16 and second motor 70 contained within the motor housing 12. The angle $\alpha$ 104 is about a 90 degree angle so that the first head 20 applies pressure in a generally horizontal direction 86 and the second head 76 applies pressure at a 90 degree angle to the first head 20. Pressure can then be applied in two directions to the two sides 90, 90' of the picture frame 92 that are being adhered together.

Figure 6A:
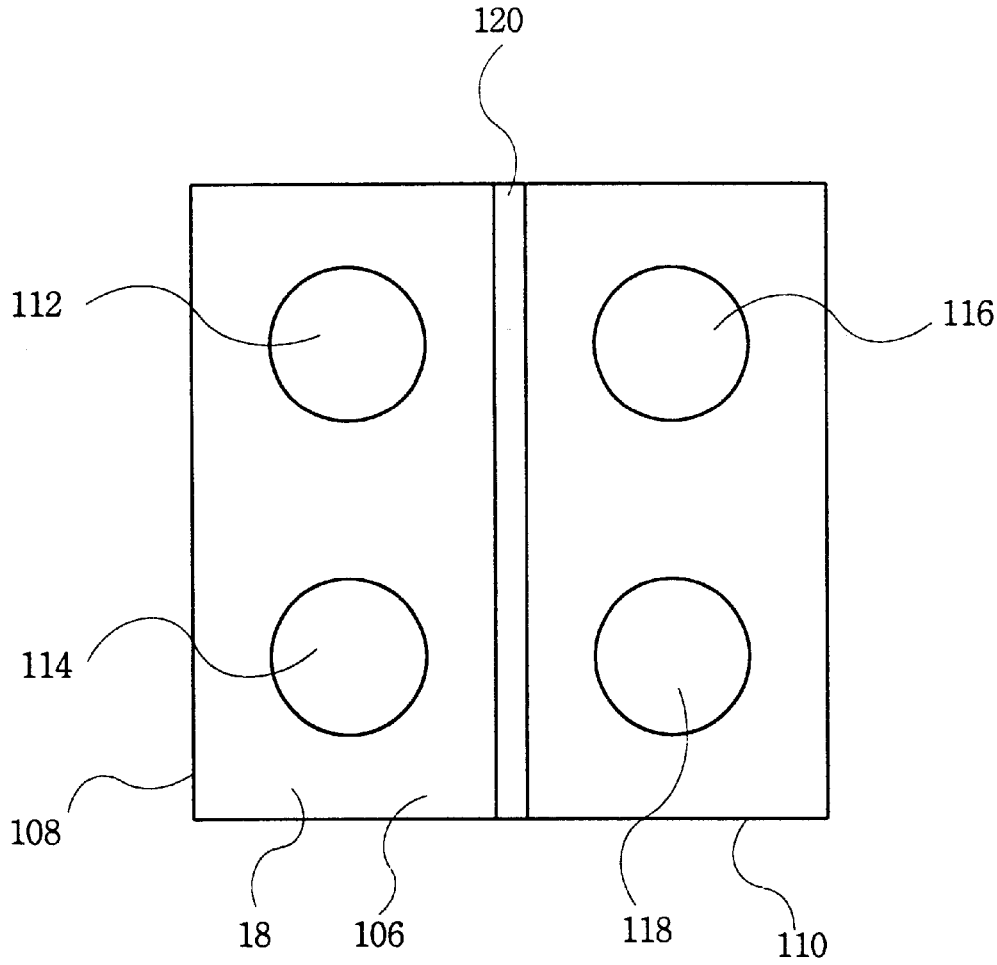
FIG. 6*a* is a perspective view of a foot switch for motor control.

FIG. 6*a* shows another variation of a motor control switch 18 that is a foot-operated switch 106. This version is specifically design for the picture framing applications with two motors 16, 70. There is a left side 108 that controls the first shaft 22 and a right side 110 that controls the second shaft 72. The left side 108 has an "in" button 112 for retracting the first shaft 22 back into the motor housing 12 and an "out" button 114 for moving the first shaft 22 toward the object to be clamped. Similarly, the right side 110 has an "in" button 116 for retracting the second shaft 72 and an "out" button 118 for moving the second shaft 72 toward the object to be clamped.

Although the present invention has been described in considerable detail with regard to the preferred versions thereof, other versions are possible. Therefore, the appended claims should not be limited to the descriptions of the preferred versions contained herein.

What is claimed is:

1. A motorized clamp device comprising:

a) a motor housing having a first channel;

b) a first motor movably positioned within the first channel;

c) a motor control switch attached to the motor housing;

d) a first head attached to and powered by the first motor, the first head having a first shaft and a first contact surface;

e) a first torque collar attached to the motor housing, the first torque collar having a first aperture that receives the first shaft; and f) a second contact surface attached to the motor housing;

wherein when the first motor causes the first shaft to rotate, the first shaft passes through the first aperture of the first torque collar and force is applied to an object by the first contact surface and the second contact surface, and the first motor travels within the first channel as the first shaft passes through the first torque collar.

2. The motorized clamp device of claim 1, further comprising a first motor collar attached to the first motor, the first motor collar having a first ear, the first channel receiving the first ear;

whereby when the first shaft rotates, the first ear is held within the first channel thus preventing the first motor from rotating within the motor housing, causing the first shaft to move through the first torque collar and the first motor to move with the first shaft, the first motor moving back and forth within the first channel of the motor housing.

3. The motorized clamp device of claim 2 further comprising:

a) a manual clamping bar, the manual clamping bar having an inner surface, a saw tooth edge, the saw tooth edge having a plurality of teeth;

wherein the second contact surface is attached to the inner surface of the manual clamping bar, and the motor housing receives the manual clamping bar;

wherein, the object may be firmly secured between the second contact surface on the manual clamping bar and the first contact surface of the first head, when the first head is actuated and applies pressure to a portion of the article.

4. The motorized clamp device of claim 3 wherein the first motor is a first bi-directional motor.

5. The motorized clamp device of claim 4 further comprising a power source attached to the motor housing for energizing the first bi-directional motor.

6. The motorized clamp device of claim 5 further comprising an adjustment device that controls a range of adjustment of the manual clamping bar, such that, the manual clamping bar is incrementally adjusted between the plurality of teeth by the adjustment device.

7. The motorized clamp device of claim 6, wherein the manual clamping bar further comprises a travel stop, such that when the travel stop comes into contact with the motor housing the travel stop limits the maximum distance of travel for the manual clamping bar.

8. The motorized clamp device of claim 7 wherein the first bi-directional motor halts the forward movement of the shaft when a preset pressure is achieved upon the object.

9. The motorized clamp device of claim 2 further comprising:

a) a manual clamping bar, the manual clamping bar having an outer surface, a saw tooth edge, the saw tooth edge having a plurality of teeth;

wherein the second contact surface is attached to the outer surface of the manual clamping bar, and the motor housing receives the manual clamping bar;

whereby when the first shaft passes through the first torque collar and exits the motor housing the first contact surface and the second contact surface increase the distance 'd2' between them, thereby creating a spreading effect.

10. The motorized clamp device of claim 2 further comprising:

a) a manual clamping bar, the manual clamping bar having an inner surface, an outer surface, a saw tooth edge, the saw tooth edge having a plurality of teeth;

wherein the second contact surface is attached to the inner surface of the manual clamping bar, and the motor housing receives the manual clamping bar;

wherein a third contact surface is attached to the outer surface of the manual clamping bar;

wherein the motor housing is removably attached to the manual clamping bar such that the motor housing may be removed from the manual clamping bar, be reversed and reattached to the motor housing, such that the first contact surface faces about 180 degrees from the initial orientation of the first contact surface such that the first contact surface faces away from the third contact surface;

whereby when the first shaft passes through the first torque collar and exits the motor housing the first contact surface and the third contact surface increase the distance 'd2' between them, thereby creating a spreading effect;

wherein, when the motor housing is in its initial position the object may be firmly secured between the second contact surface on the manual clamping bar and the first contact surface of the first head, when the first head is actuated and applies pressure to a portion of the article.

11. The motorized clamp device of claim 2, wherein the motor housing further having a second channel.

12. The motorized clamp device of claim 11 further comprising:

a) a second motor movably positioned within the second channel;

b) a second head attached to and powered by the second motor, the second head having a second shaft and the second contact surface attached to the second shaft; and c) a second torque collar attached to the motor housing, the second torque collar having a second aperture that receives the second shaft.

13. The motorized clamp device of claim 12, further comprising a second motor collar attached to the second motor, the motor collar having a second ear, the second channel receiving the second ear; whereby when the second shaft rotates, the second ear is held within the second channel thus preventing the second motor from rotating within the motor housing, causing the second shaft to move through the second torque collar and the second motor to move with the second shaft, the second motor moving back and forth within the second channel of the motor housing.

14. The motorized clamp device of claim 13 wherein the first shaft has a first axis running along the first centerline of the first shaft and a second axis running along the second centerline of the second shaft;

wherein the intersection of the first axis and second axis create an angle $\alpha$ that is less than a 180 degree angle, such that an opposing object receives force from the first head and the second head.

15. The motorized clamping device of claim 14, wherein the first motor and second motor form substantially an "L" shape.

16. The motorized clamp device of claim 15 wherein the angle $\alpha$ is about a 90 degree angle; whereby the first head applies pressure in a generally horizontal direction and the second head applies pressure in a direction that varies about 90 degrees from the direction of the first head.

17. The motorized clamp device of claim 16 wherein the first motor is a first bi-directional motor and the second motor is a second bi-directional motor.

18. The motorized clamping device of claim 17 wherein the forward movement is stopped of the first bi-directional motor and the second bi-directional motor, the first shaft, second shaft, first contact surface, and second contact surface when a preset pressure is achieved upon the opposing object.

19. The motorized clamping device of claim 18, wherein the motor control switch is a foot-operated switch that allows the hands to remain free.

20. The motorized clamp device of claim 19 further comprising a power source attached to the motor housing for energizing the first bi-directional motor and second bi-directional motor.

* * * * *